United States Patent [19]

Tsuji

[11] Patent Number: 4,591,985

[45] Date of Patent: May 27, 1986

[54] APPARATUS FOR ESTIMATING TRAFFIC CONDITION VALUE OF ELEVATORS

[75] Inventor: Shintaro Tsuji, Nagoya, Japan

[73] Assignee: Mitsubishi Denki Kabushiki Kaisha, Tokyo, Japan

[21] Appl. No.: 549,750

[22] Filed: Nov. 8, 1983

[30] Foreign Application Priority Data

Nov. 8, 1982 [JP] Japan ..... 57-195736

[51] Int. Cl.[4] ..... G66B 1/20

[52] U.S. Cl. ..... 364/424; 364/581; 187/29 R

[58] Field of Search ..... 364/424, 581; 187/29 R

[56] References Cited

U.S. PATENT DOCUMENTS 4,044,860 8/1977 Kaneko et al. ..... 187/29 R
4,363,381 12/1982 Bittar ..... 187/29 R
4,448,286 5/1984 Kuzunuki ..... 187/29 R
4,473,134 9/1984 Uetani ..... 187/29 R
4,524,418 6/1985 Araya et al. ..... 187/29 R

*Primary Examiner*—Gary Chin
*Attorney, Agent, or Firm*—Leydig, Voit & Mayer, Ltd.

[57] ABSTRACT

An apparatus for estimating the traffic demand value of elevators wherein the period of time of elevator operation is divided into a plurality of sections, the traffic demand value for each section is measured, and an estimated traffic demand value of a corresponding section is estimated on the basis of the measured value. A weight coefficient is provided in accordance with a result of the comparison between the estimated and measured demand values to prevent the estimated value from greatly differing from the actual traffic demand whereby the elevators can be accurately group-supervised as intended.

7 Claims, 11 Drawing Figures

APPARATUS FOR ESTIMATING TRAFFIC CONDITION VALUE OF ELEVATORS

BACKGROUND OF THE INVENTION

This invention relates to an apparatus for estimating the traffic condition value of elevators in which the traffic condition value such as the numbers of persons ascending and descending with the elevators or the service states of the elevators is estimated on the basis of a measured value.

A traffic condition value in an elevator system, for example, the number of persons who ascend and descend the elevators, fluctuates irregularly when closely observed within a period of one day, but presents similar aspects for the same time zones when observed over several days. In, for example, an office building, elevator passengers on their way to their office floors crowd on the first floor during a short period of time in the time zone in which they attend offices in the morning. In the first half of the lunch hour, many passengers go from the office floors to a restaurant floor, while in the latter half thereof, many passengers go from the restaurant floor and the first floor to the office floors. Further, many passengers go from the office floors to the first floor in the time zone in which they leave the offices in the evening. The volumes of traffic in the up direction and in the down direction are nearly equal to the daytime time zones other than mentioned above, while the volume of traffic becomes very small throughout the nighttime.

In order to deal with the traffic in a building changing in a manner described above and having a limited number of elevators, the elevators are usually operated under group supervision. One of the important roles of the group supervision of the elevators is to assign an appropriate elevator to each hall call registered. Various assignment systems for the hall calls have been proposed.

By way of example, there has been adopted a system wherein, when a hall call is registered anew, it is tentatively assigned to respective elevators, and the waiting times of all hall calls, the possibility of full capacity of passengers, etc. are estimated so as to select the appropriate elevator from among the elevators. In order to execute such estimative calculations, data on a traffic condition value peculiar to each building is required. For example, data on the number of passengers who get on and off the cage of each elevator at intermediate floors is required for estimating the possibility of full capacity as the traffic condition varies. When such traffic demand value, which changes every moment, is stored each time, an enormous memory capacity is necessitated, which is not practical. It is therefore common practice to reduce the required memory size by dividing the operating period of time in one day into several time zones and storing only the average traffic demand values of the respective time zones. Soon after the completion of the building, however, there is a high possibility that the traffic demand value will change in accordance with changes in personnel organization in the building. In order to precisely estimate the traffic demand value even against such changes of the personnel organization, there has been proposed a system wherein the traffic demand value in the building is measured, and the estimated traffic demand is sequentially corrected to follow the change of the traffic condition value.

More specifically, the operating period of time in one day is divided into K time zones (hereinbelow, termed "sections"), and a time (hereinbelow, termed "boundary") by which a section $k-1$ and a section k are bounded is denoted by $t_k$ ($k=2, 3, \ldots, K$). Times $t_1$ and $t_{k+1}$ are the starting time and end time of the elevator operation, respectively. The average traffic condition value $P_k(l)$ of the section k on the l-th day is supposed to be given by the following Equation (1):

$$P_k(l) = \frac{1}{t_{k+1} - t_k} \begin{pmatrix} X_k^u(l) \\ X_k^d(l) \\ Y_k^u(l) \\ Y_k^d(l) \end{pmatrix} \tag{1}$$

Here, $X_k^u(l)$ is a column vector of $(F-1)$ dimensions (where F denotes the number of floors) the elements of which are the number of passengers to get on cages in the up direction at respective floors in the time zone k of the l-th day. Similarly, $X_k^d(l)$, $Y_k^u(l)$ and $Y_k^d(l)$ are column vectors which indicate the number of passengers to get on the cages in the down direction, the number of passengers to get off the cages in the up direction and the number of passengers to get off the cages in the down direction, respectively. The average traffic condition value $P_k(l)$ is measured by a passenger-number detector which utilizes load changes during the stoppage of the cages of the elevators and/or industrial television, ultrasonic wave, or the like.

First, the case where the representative value of the average traffic condition value $P_k(l)$ of each time zone having a fixed boundary time $t_k$ is sequentially corrected is considered.

It is thought that the columns $\{P_k(1), P_k(2), \ldots\}$ of the average traffic demand values measured daily will disperse in the vicinity of a certain representative value $P_k$. Since the magnitude of the representative value $P_k$ is unknown, it needs to be estimated. In this case, there is the possibility that the magnitude itself of the representative value $P_k$ will change. The representative value is therefore estimated by taking a linear weighted average given in Equations (2) and (3) below, whereby more importance is attached to the average traffic demand value $P_k(l)$ measured latest than to the other average traffic condition values $P_k(1), P_k(2), \ldots$ and $P_k(l-1)$.

$$\hat{P}_k(l) = (1-a)^l P_k(O) + \sum_{i=1}^{l} \lambda_i P_k(i) \tag{2}$$

$$\lambda_i = a(1-a)^{l-i} \tag{3}$$

Here, $\hat{P}_k(l)$ is the representative value which has been estimated for the average traffic demand values $P_k(1), \ldots$, and $P_k(l)$ measured till the l-th day, and $P_k(O)$ is an initial value which is set at a suitable value in advance. $\lambda_i$ denotes the weight of the average traffic demand value $P_k(i)$ measured on the i-th day, and this weight changes depending upon a parameter a as expressed by Equation (3). More specifically, an increase in the value of the parameter a results in an estimation in which more importance is attached to the latest measured average traffic demand value $P_k(l)$ than to the other average traffic demand values $P_k(1), \ldots$ and $P_k(l-1)$, and in which the estimated representative value $\hat{P}_k(l)$ quickly follows up the change of the representative value $P_k$. However, when the value of the parameter a is too large, it is feared that the estimated representative value will change too violently in a manner to be influenced by the random variation of daily data. Meanwhile, Equations (2) and (3) can be rewritten as follows:

$$\hat{P}_k(l)=(1-a)P_k(l-1)+aP_k(l) \quad (4)$$

$$\hat{P}_k(O)=P_k(O) \quad (5)$$

In accordance with the above Equations (4) and (5), there is the advantage that the weighted average of Equation (2) can be calculated without storing the measurement values $P_k(i)(i=1, 2, \ldots, l-1)$ of the average traffic demand values in the past.

However, even when a traffic demand value which fluctuates cyclically on weekdays becomes an extremely different magnitude on Sunday, a national holiday or the like or when a irregular traffic demand value whose magnitude abruptly increases temporarily arises as immediately before the starting or after the end of a conference or an assembly, the measured result of such magnitude has heretofore been adopted for the estimation of the traffic demand value without being distinguished from the others. This has sometimes led to the drawback that the estimated value causes a great difference from the actual traffic demand value on the weekday, so the elevators are not group-supervised as intended.

SUMMARY OF THE INVENTION

This invention has been made in view of the drawback described above, and has for its object to provide an apparatus for estimating the traffic demand value of elevators wherein the period of time of an elevator operation is divided into a plurality of sections, the traffic demand value concerning the elevators is measured for each of the sections, and the traffic demand value of the corresponding section of a subsequent operation is estimated from the measured value. The apparatus comprises comparison means for comparing the measured value and the estimated value determined from a previous period, and weighting means for producing a coefficient to apply to the measured value on the basis of the compared result, the weighted measured value being used for obtaining an estimated value anew, whereby the estimated value is prevented from causing a great difference from an actual magnitude of the traffic demand value, thereby group supervising the elevators as intended.

BRIEF DESCRIPTION OF THE DRAWINGS

FIGS. 3 to 11 show an embodiment of this invention, in which:

FIG. 3 is a block diagram showing a whole elevator system;

FIG. 4 is a memory map diagram of a random access memory;

FIG. 5 is a memory map diagram of a read-only memory;

FIG. 6 is a diagram showing the general flow of programs;

FIG. 7 is a flow chart showing an example of an initializing program;

FIG. 8 is a flow chart showing an example of an up direction demand calculating program;

FIG. 9 is a flow chart showing an example of a comparing program;

FIG. 10 shows an average demand estimating program; and

FIG. 11 shows an output program.

DESCRIPTION OF THE PREFERRED EMBODIMENT

Referring now to FIGS. 1 to 11, an embodiment of this invention will be described in connection with a traffic demand value which is expressed in two dimensions.

Figure 1:
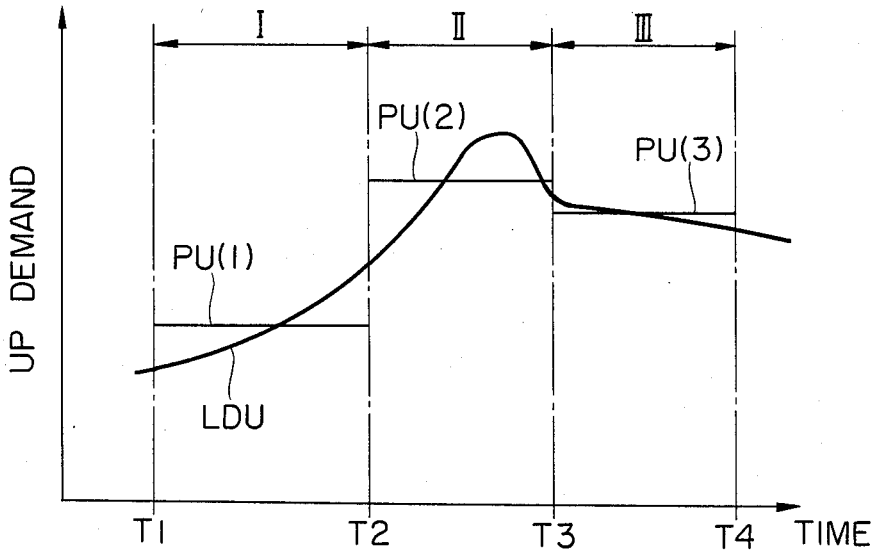
FIGS. 1 and 2 are explanatory diagrams showing the fluctuations of traffic condition values concerning elevators.
Figure 2:
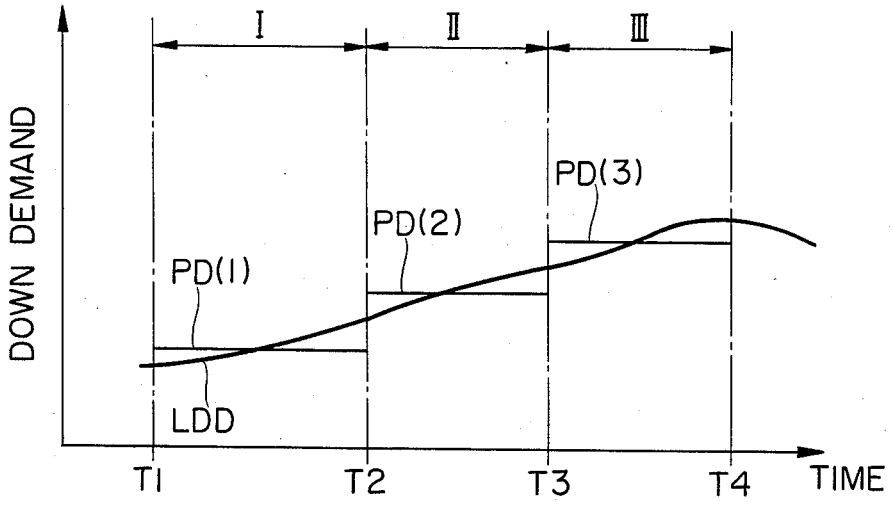

First, FIGS. 1 and 2, respectively, illustrate traffic demand values in the form of the numbers of persons who move in the up direction and down direction within a building. LDU indicates the up direction demand value which is obtained in such a way that the numbers of persons moving in the up direction at predetermined times are measured and totaled for all floors, whereupon the total values are cumulated every unit time DT (set at 5 minutes). Similarly, the down direction demand value LDD is obtained in such a way that the numbers of persons moving in the down direction at predetermined times are measured and totaled for all the floors, whereupon the total values are cumulated every unit time DT. T1 denotes the boundary which is the starting time of a section I, T2 the boundary between the section I and a section II, T3 the boundary between the section II and a section III, and T4 the boundary which is the end time of the section III. PU(1) and PD(1) designate an average up direction demand value and an average down direction demand value in the section I, respectively. They correspond to the average traffic volume $P_k(l)$ resulting when values obtained by cumulating the up direction demand value LDU and the down direction demand value LDD in the section I are respectively substituted into $X_k^u(l)$ and $X_k^d(l)$ in Equation (1), and the column vectors $Y_k^u(l)=0$ and $Y_k^d(l)=0$ are assumed. PU(2) and PD(2), and PU(3) and PD(3) similarly designate an average up direction demand value and an average down direction demand value in the section II, and an average up direction demand value and an average down direction demand value in the section III, respectively.

Figure 3:
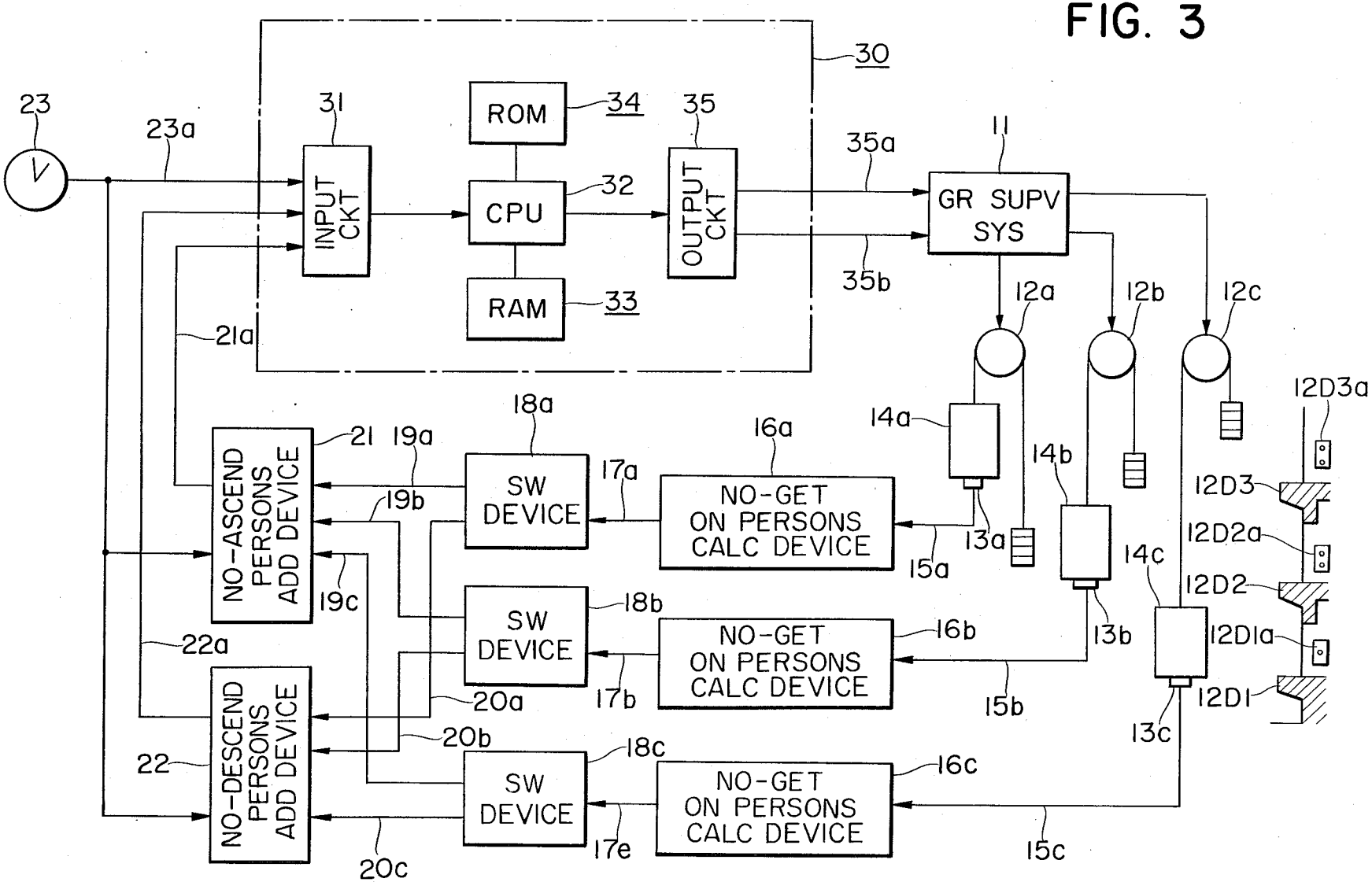

Secondly, FIG. 3 is a block diagram showing a whole elevator system. In the figure, numeral 11 designates a group supervisory system which group-supervises three elevators 12*a*, 12*b* and 12*c*. Symbols 12D1–12D3 indicate the first—third floors to be served by the elevators 12*a*, 12*b* and 12*c*, respectively. Symbols 12D1*a*–12D3*a* indicate a first floor hall button—a third floor hall button which are respectively disposed at the first floor 12D1—the third floor 12D3, and with which up hall calls and down hall calls can be registered.

Symbols 13*a*, 13*b* and 13*c* designate number-of-persons detection means which are constructed of well-known weighting devices disposed under the floors of the cages 14*a*, 14*b* and 14*c* of the elevators 12*a*, 12*b* and 12*c*, respectively. They provide number-of-persons signals 15*a*, 15*b* and 15*c* proportional to the actual numbers of passengers, respectively. Symbols 16*a*, 16*b* and 16*c* indicate number-of-getting on persons calculation devices for calculating the numbers of persons who have gotton on the cages 14*a*, 14*b* and 14*c*, as disclosed in, e.g., the official gazette of Japanese Laid-open Patent Application No. 51-97155. They detect the minumum values of the respective number-of-persons signals 15*a*, 15*b* and 15*c* at the times when doors (not shown) are open. Further, they subtract the minimum values of the number-of-persons signals 15*a*, 15*b* and 15*c* from the number-of-persons signals 15*a*, 15*b* and 15*c* immediately before the cages 14*a*, 14*b* and 14*c* start upon the closure of the doors, thereby to provide number-of-getting on persons signals 17*a*, 17*b* and 17*c*, respectively. Switching devices 18*a*, 18*b* and 18*c* deliver the number-of-getting on persons signals 17*a*, 17*b* and 17*c* to signal lines 19*a*, 19*b* and 19*c* while the elevators 12*a*, 12*b* and 12*c* are continuing ascent operations, and they deliver these signals to signal lines 20*a*, 20*b* and 20*c* while the elevators are continuing descent operations, respectively. Numbers-of-ascending persons addition device 21 adds the respective number-of-getting on persons signals 17*a*, 17*b* and 17*c* inputted by the signal lines 19*a*, 19*b* and 19*c* and cumulates them for the unit time DT, and it provides an up-direction number-of-passengers signal 21*a* obtained by the cumulation. Numbers-of-descending persons addition device 22 adds the respective number-of-getting on persons signals 17*a*, 17*b* and 17*c* inputted by the signal lines 20*a*, 20*b* and 20*c* and cumulates them for the unit time DT, and it provides a down-direction number-of-passengers signal 22*a* obtained by the cumulation. Clock means 23 produces a timing signal 23*a* each time the unit time DT lapses, thereby to reset the up-direction number-of-passengers signal 21*a* and the down-direction number-of-passengers signal 22*a* to zero. Shown at numeral 30 is a demand estimation device which is constructed of an electronic computer such as a microcomputer. It comprises an input circuit 31 which is constructed of a converter for receiving the up-direction number-of-passengers signal 21*a*, the down-direction number-of-passengers signal 22*a* and the timing signal 23*a*; a central processing unit 32 which operates and processes the respective signals received by the input circuit 31; a random access memory (hereinbelow, termed "RAM") 33 which stores data such as the operated results of the central processing unit (hereinbelow, termed "CPU") 32; a read only memory (hereinbelow, termed "ROM") 34 which stores programs, constant value data, etc.; and an output circuit 35 which is constructed of a converter for delivering signals from the CPU 32. Signal lines 35*a* and 35*b* transmit the signals of the output circuit 35 to the group supervisory system 11.

Figure 4:
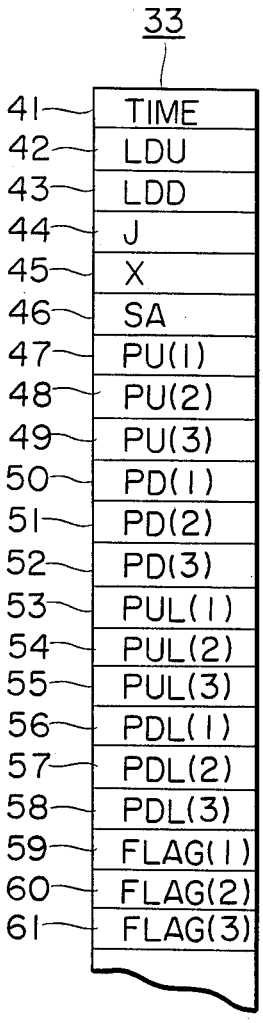

FIG. 4 shows the content of the RAM 33. Referring to the figure, numeral 41 indicates a memory area in which a time TIME obtained from the timing signal 23*a* is stored. A memory area 42 stores the up direction demand value LDU which is the accepted up-direction number-of-passengers signal 21*a*, while a memory area 43 stores the down direction demand value LDD which is the accepted down-direction number-of-passengers signal 22*a*. A memory area 44 stores a counter J which is used as a variable indicative of any of the sections I–III. A memory area 45 stores a distance X which is used as a variable expressive of the extent of the similarity between the estimated average demand value and the measured average demand value for each section. A memory area 46 stores a weight coefficient SA which is used as a variable corresponding to the parameter a in Equation (4). Memory areas 47–49 store the average up direction demand values PU(1)–PU(3) in the sections I–III, respectively, while memory areas 50–52 store the average down direction demand values PD(1)–PD(3) in the sections I–III, respectively. Memory areas 53–55 store estimated average up direction demand values PUL(1)–PUL(3) which correspond to representative values $\hat{P}_k(l)$ obtained by substituting the average up direction demand values PU(1)–PU(3) into Equation (4), respectively, while memory areas 56–58 store estimated average down direction demand values PDL(1)–PDL(3) which correspond to representative values $\hat{P}_k(l)$ obtained by substituting the average down direction demand values PD(1)–PD(3) into Equation (4), respectively. Memory areas 59–61 store flags FLAG(1)–FLAG(3) which are set at 1 (one) when the average demands PU(1)–PU(3) and PD(1)–PD(3) measured in the sections I–III differ from usual magnitudes and the distance X is not smaller than a reference value, respectively.

Figure 5:
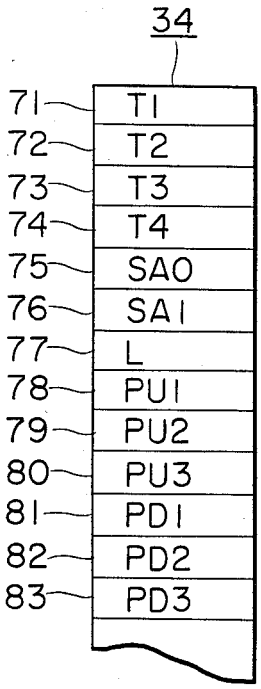

FIG. 5 shows the content of the ROM 34. Referring to the figure, numerals 71–74 designate memory areas in which the boundaries T1–T4 set at 85 (=7:05), 99 (=8:15), 108 (=9:00) and 122 (=10:10) are stored respectively. Memory areas 75 and 76 store weight coefficients SA0 and SA1 which correspond to the parameter a in Equation (4) and which are set at 0.2 and 0.01, respectively. In a memory area 77, the reference value L for deciding the distance X is set at 400. Memory areas 78–80 store the initial values PU1–PU3 of the estimated average up-direction demands PUL(1)–PUL(3), which are set at 65 (passengers/5 minutes), 130 (passengers/5 minutes) and 109 (passengers/5 minutes), respectively. Memory areas 81–83 store the initial values PD(1)–PD(3) of the estimated average down-direction demands PDL(1)–PDL(3), which are set at 5 (passengers/5 minutes), 7 passengers/5 minutes) and 20 (passengers/5 minutes), respectively.

Figure 6:
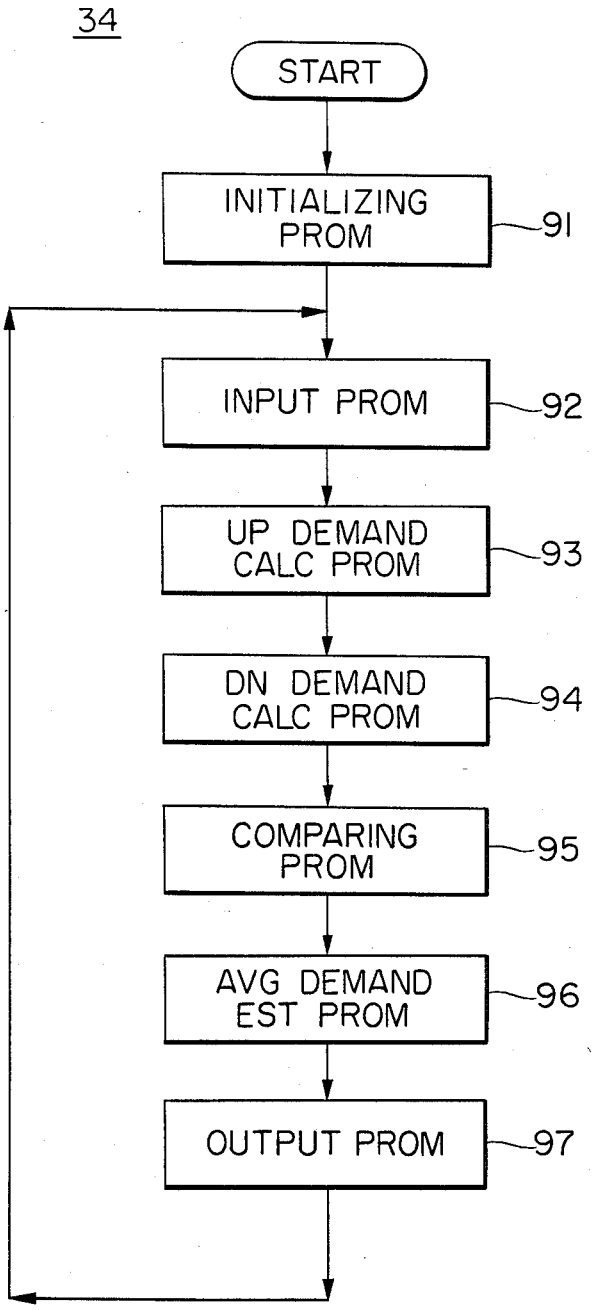
Figure 7:
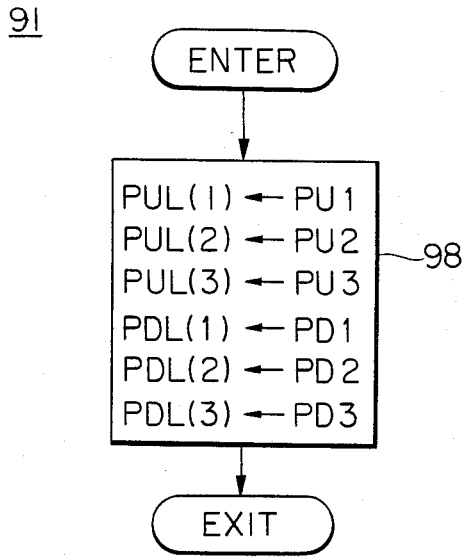
Figure 8:
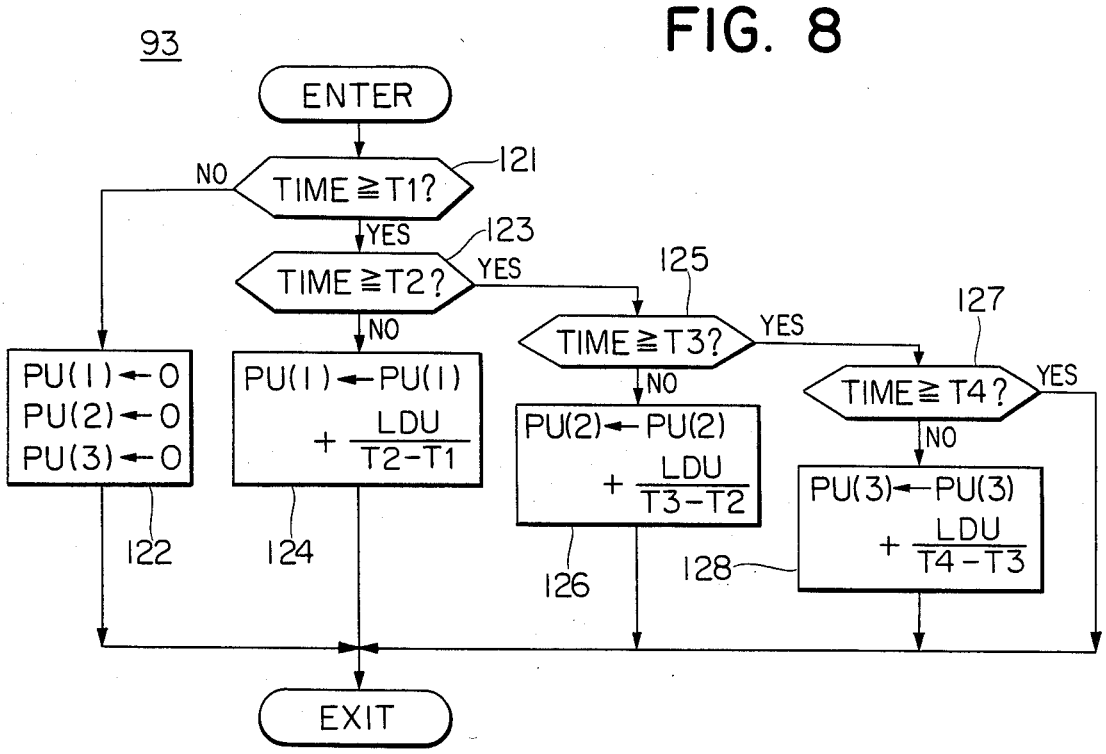
Figure 9:
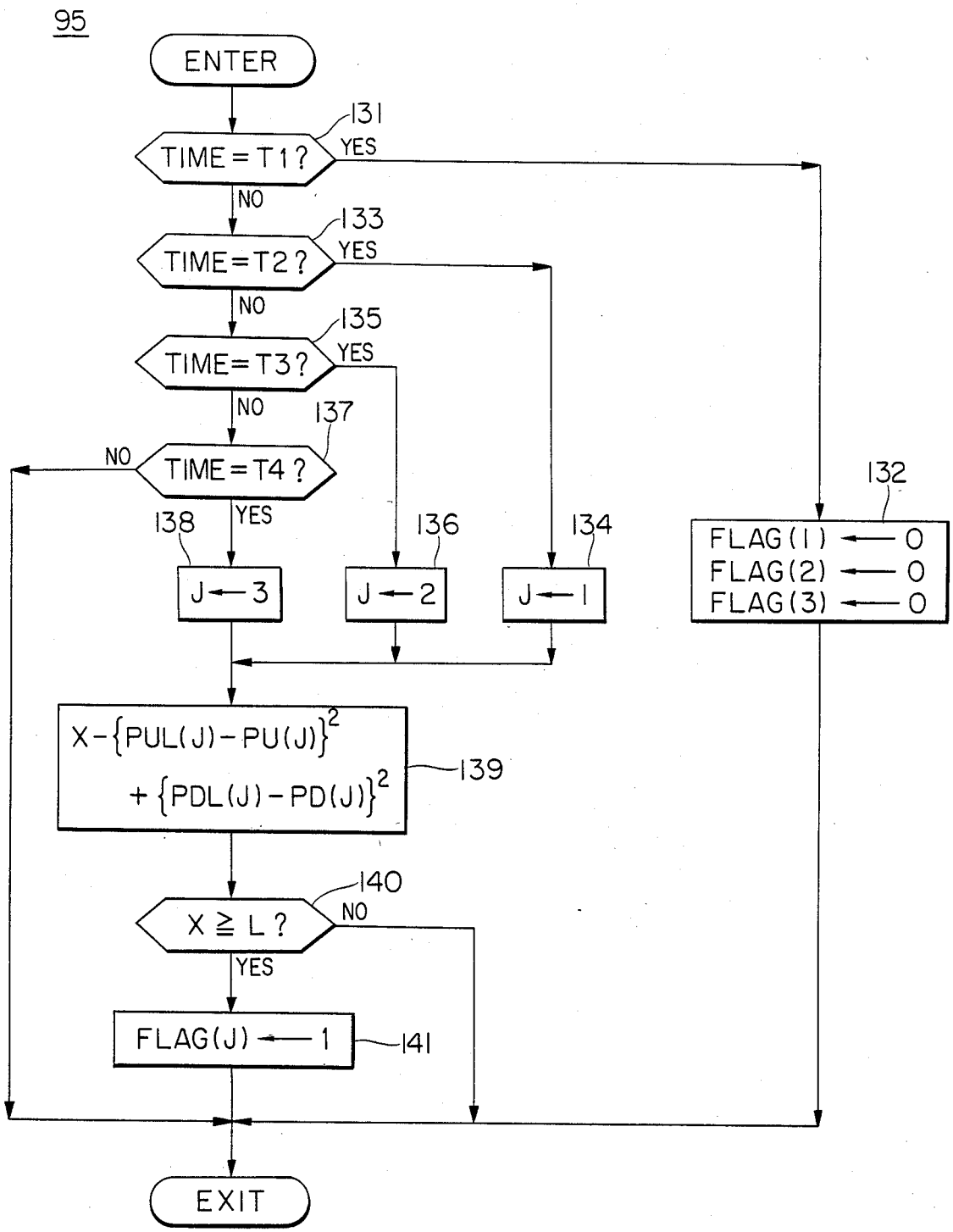
Figure 10:
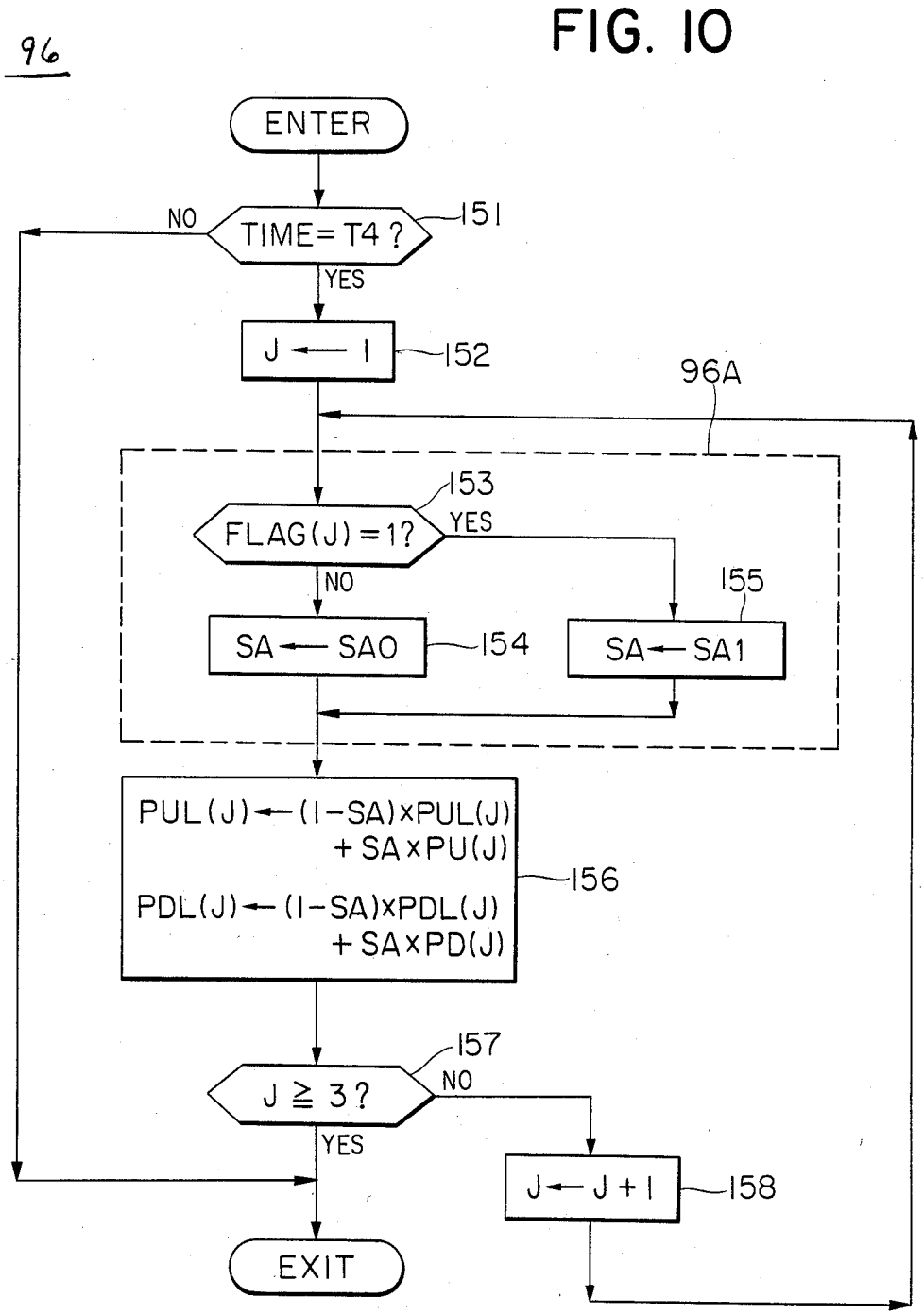

FIG. 6 illustrates the general flow of programs which are stored in the ROM 34 in order to estimate the average demand value. Referring to the figure, numeral 91 designates an initializing program for setting the initial values of various data. An input program 92 accepts signals from the input circuit 31 and sets them in the RAM 33. An up demand calculating program 93 calculates the average up-direction demand values PU(1)–PU(3) measured in the respective sections I–III, while a down demand calculating program 94 calculates the average down-direction demand values PD(1)–PD(3) similarly to the above. A comparing program 95 makes comparisons for deciding if the measured average up-direction demands PU(1)–PU(3) and average down-direction demands PD(1)–PD(3) differ from usual magnitudes. A weighting program 96A (refer to FIG. 10) weights the measured value. An average demand estimating program 96 calculates the estimated average up-direction demands PUL(1)–PUL(3) and estimated average down-direction demands PDL(1)–PDL(3) in the respective sections I–III. An output program 97 transmits the estimated average up-direction demands PUL(1)–PUL(3) and estimated average down-direction demands PDL(1)–PDL(3) from the output circuit 35 to the group supervisory system 11 through the signal lines 35*a* and 35*b*, respectively.

The operations of the apparatus for estimating the traffic demand value of elevators constructed as thus far described will be described with reference to flow charts shown in FIGS. 7–11.

First, the numbers of persons who have gotten on the cages 14*a*–14*c* are respectively calculated by the number-of-getting on persons calculation means 16*a*–16*c*. Among these numbers of persons, the numbers concerning the ascent operations are applied to the numbers-of-ascending persons addition device 21, and the numbers concerning the descent operations are applied to the numbers-of-descending persons addition device 22, in such a manner that the number-of-getting on persons signals 17*a*–17*c* are switched by the switching devices 18*a*–18*c*. The respective numbers of the persons who have gotten on the cages are added, whereupon the up-direction number-of-passengers signal 21*a* down-direction number-of-passengers signal 22*a* are provided and sent to the input circuit 31. Besides, the number of counts produced when the value 1 (one) is counted every 5 minutes since a time 0 (zero) o'clock is provided as the timing signal 23*a* from the clock means 23, and it is sent to the input circuit 31.

On the other hand, when the demand estimation device 30 is first connected to a power source (not shown), the initializing program 91 is actuated. More specifically, as illustrated in detail in FIG. 7, at Step 98, the initial values PU1–PU3 are respectively set for the estimated average up-direction demands PUL(-1)–PUL(3), and the initial values PD1–PD3 are respectively set for the estimated average down-direction demand values PDL(1)–PDL(3). Then, the control flow shifts to the input program 92.

The input program 92 is a well-known program which feeds the input signal from the input circuit 31 into the RAM 33. By way of example, when the time is 8 o'clock, the input program reads the value 96 from the input circuit 31 and shifts it to the memory area 41 so as to set the time TIME at 96. Likewise, the up-direction number-of-passengers signal 21*a* is accepted and stored as the up direction demand value LDU, while the down-direction number-of-passengers signal 22*a* is accepted and stored as the down direction demand value LDD.

Next, the operations of the up demand calculating program 93 will be explained.

At Step 121, it is decided whether or not the time zone in which the average demand is to be calculated has been reached. When the time TIME is smaller than the boundary T1, the control flow proceeds to Step 122, at which all the average up-direction demand values PU(1)–PU(3) are set at 0 (zero) as the initializing operation for the calculation of the average demand value. When the time TIME becomes equal to or greater than the boundary T1 at Step 121, the control flow proceeds to Step 123. When the time TIME is smaller than the boundary T2 here, the control flow proceeds to Step 124, at which the average up-direction demand value PU(1) of the section I is corrected by the use of the up direction demand value LDU measured anew, so as to increase to the amount of the up direction demand value per unit time DT as denoted by LDU/(T2−T1). When the time TIME is T2≦TIME<T3, the control flow proceeds along Steps 123→125→126, at which the average up-direction demand value PU(2) of the section II is corrected in the same manner as at Step 124. Further, if the time TIME is T3≦TIME<T4, the control flow proceeds along Step 125→127→128, at which the average up-direction demand value PU(3) of the section III is corrected in the same manner as at Step 124.

In this way, the average up-direction demand values PU(1)–PU(3) of the sections I–III are sequentially corrected in the up demand calculating program 93.

Next, the down demand calculating program 94 sequentially corrects the average down-direction demand values PD(1)–PD(3) of the sections I–III likewise to the up demand calculating program 93, and it will not be explained in detail.

Now, the operations of the comparing program 95 will be described.

In general, in a case where the degree of similarity is investigated by comparing two multidimensional variables in a multidimensional space, a "norm" corresponding to the distance between two points in the multidimensional space is often used. By way of example, in case of judging how the measured value $P_k(l)$ of the average demand and the estimated value $\hat{P}_k(l-1)$ thereof estimated till then are similar, the norm X is calculated by the following Equation:

$$X=||\hat{P}_k(l-1)-P_k(l)||^2 \quad (6)$$

As the value of the norm X is closer to 0 (zero), it is judged that the estimated value $P_k(l-1)$ of the average demand and the measured result $P_k(l)$ thereof are more similar, whereas as the value of the norm X is larger, it is judged that the estimated value $\hat{P}_k(l-1)$ of the average demand and the measured result $P_k(l)$ thereof are more different.

When, in the comparing program 95 of the present embodiment, the time TIME has agreed with the boundary T1 which is the starting time of the section I, Step 131 proceeds to Step 132, at which the flags FLAG(1)–FLAG(3) are reset to 0 (zero).

When the time TIME has agreed with the boundary T2 which is the end time of the section I (namely, the starting time of the section II), the control flow proceeds along Steps 131→133→134, at which the counter J is set 1 (one). Step 139 calculates the distance X for assessing to what extent the average up-direction demand PU(1) and average down-direction demand PD(1) measured in the section I are similar to the estimated average up-direction demand PUL(1) and estimated average down-direction demand PDL(1) obtained till then. For example, in a case where the average up-direction demand PU(1) and average down-direction demand PD(1) are 70 (passengers/5 minutes) and 7 (Passengers/5 minutes) respectively and where the estimated average up-direction demand PUL(1) and estimated average down-direction demand PDL(1) are set at 60 (passengers/5 minutes) and 10 (passengers/5 minutes) respectively, the distance X is calculated as $X=(60-70)^2+(10-7)^2=109$ in accordance with Equation (6). At the next Step 140, the distance X and the reference value L are compared. In the case of the distance X=109 as mentioned above, it is smaller than the reference value L (=400), and hence, the control flow proceeds to the exit. In contrast, in a case where the average up-direction demand PU(1) and average down-direction demand PD(1) have been respectively measured as 30 (passengers/5 minutes) and 2 (passengers/5 minutes) by way of example, the distance $X=(60-30)^2+(10-2)^2=964>$reference value L (=400) holds, and hence, the control flow proceeds to Step 141. Here, the flag FLAG(1) of the section I is set at 1 (one) in order to express that the demand of the section I measured on the particular day differs in magnitude from the demand on normal days.

When the time TIME agrees with the boundary T3 which is the end time of the section II, the control flow proceeds along Steps 131→133→135→136, at which the counter J is set at 2. When the time TIME agrees with the boundary T4 which is the end time of the section III, the control flow proceeds along Steps 131→133→135→137→138, at which the counter J is set at 3. Thereafter, the distance X is calculated as in the case of the section I, to investigate the change of the demand.

In this manner, the comparing program 95 sets, at the end times T2–T4 of the sections I–III, the flags FLAG(1)–FLAG(3) which express that the average up-direction demands PU(1)–PU(3) and average down-direction demands PD(1)–PD(3) measured in the respective sections I–III have magnitudes different from normal ones.

Now, the operations of the weighting program 96A and the average demand estimating program 96 will be described.

Only when, at Step 151, the time TIME arrives at the boundary T4 which is the end time of the section III, the following Steps 152–158 are executed. At Step 152, the counter J is initialized to 1 (one). Here, when the average up-direction demand PU(1) and average down-direction demand PD(1) measured in the section I, namely, at J=1 are decided to have the ordinary magnitudes of the average demands, that is, the flag FLAG(1)=0 holds, Step 153 proceeds to Step 154. Here, the weight coefficients SA is set at the value (=0.2) of the usual weight coefficient SA0, whereupon the control flow proceeds to Step 156. Here, the estimative average up-direction demand PUL(1) calculated till the preceding day is multiplied by (1−SA) and is added to the average up-direction demand PU(1) just measured on the particular day as multiplied by SA, to set an estimated average up-direction demand PUL(J) anew. Likewise, the estimated average down-direction demand PDL(J) is set again. On the other hand, when the average up-direction demand PU(1) and average down-direction demand PD(1) measured in the section I are decided to differ in magnitude from the ordinary average demands at Step 153, that is, the flag FLAG(1)=1 holds, Step 153 proceeds to Step 155.

Here, the weight coefficient SA is set at the unusual weight coefficient SA1 (=0.01). Steps 153–155 constitute weighting means which is formed of the weighting program 96A for setting the weight coefficient SA. At Step 156, the estimated average up-direction demand PUL(1) and estimated average down-direction demand PDL(1) are calculated as described above. At Steps 157 and 158, the counter J is increased one by one until the counter J≧3 is established, and the calculations of Steps 153–156 are repeated for the sections II and III as in the case of the section I.

In this manner, according to the average demand estimating program 96, when it is judged before calculating the average demand every day that the measured result of the average demand obtained on the particular day is greatly different from the estimated value thereof obtained till then, the value of the weight coefficient SA is set to be smaller than the ordinary magnitude, and the estimated value of the average demand is calculated with the smaller weight coefficient, thereby to prevent any bad influence on the estimated value of the demand.

Figure 11:
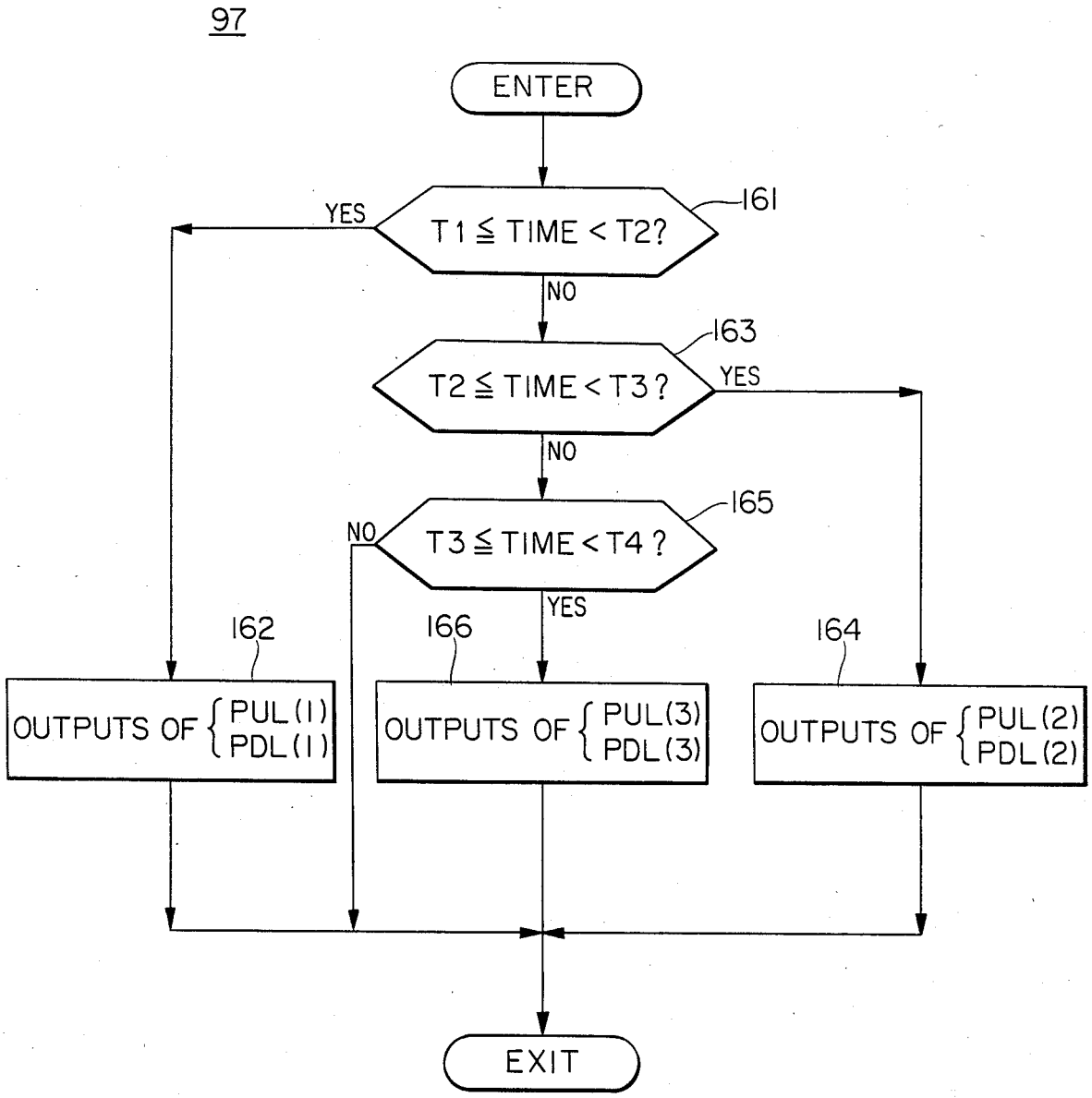

The estimated average up-direction demands PUL(1)–PUL(3) and estimated average down-direction demands PDL(1)–PDL(3) in the respective sections I–III as calculated in the way described above are transmitted from the output circuit 35 via the signal lines **35*a* and 35*b* to the group supervisory system 11 by the output program 97. Referring to FIG. 11, first, in the section I (T1≦TIME<T2), the program proceeds along Steps 161→162, at which the estimated average up-direction demand PUL(1) in the section I is delivered onto the signal line 35*a* and the estimated average down-direction demand PDL(1) onto the signal line 35*b*. Likewise, in the average II (T2≦TIME<T3), the program proceeds along Steps 161→163→164, at which the estimated average up-direction demand PUL(2) and estimated average down-direction demand PDL(2) in the section II are respectively delivered onto the signal lines 35*a* and 35*b*. In the section III (T3≦TIME<T4), the program proceeds along Steps 161→163→165→166, at which the estimated average up-direction demand PUL(3) and estimated average down-direction demand PDL(3) in the section III are respectively delivered onto the signal lines 35*a* and 35*b*. The group supervisory system 11 group-supervises the elevators 12*a*–12*c*** on the basis of these estimated average up-direction demands PUL(1)–PUL(3) and estimated average down-direction demands PDL(1)–PDL(3).

Although, in the embodiment, the case has been exemplified where the demand obtained by totaling the up direction demand and down direction demand in the three sections is estimated, it is to be understood that this invention is also applicable to a case of estimating demands in four or more sections or a case of estimating demands for respective floors (in individual directions).

In the embodiment, the weight coefficient SA has been chosen between the two values in such a manner that the value smaller than the ordinary value is set when the measured result of the average demand differs from the estimated value in excess of the predetermined magnitude, but the way of setting the weight coefficient SA is not restricted thereto. It is also easy to set the weight coefficient SA in three or more divided stages, depending upon the extent of the difference between the measured result and the estimated value. Moreover, although the value of the weight coefficient SA has been set at 0.2 or 0.01, such values should desirably be set in consideration of the intended use of a building, the natures of respective floors, the features of time zones, etc. It is apparent from Equation (4) that setting the value of the weight coefficient SA1 especially at 0 (zero) is equivalent to using none of measured results different from an ordinary result, for the calculation of the estimated value.

Further, although the boundaries T1–T4 have been fixed in the embodiment, this invention is also applicable to a case where they change with the changes of the demands.

Although, in the embodiment, the traffic condition value has been the demand in the form of the numbers of persons who move in the up direction and down direction respectively, it may well be the numbers of hall calls at the respective floors. In this case, the numbers of hall calls can be estimated by defining the following:

LDU: the number of hall up calls obtained in such a way that up calls on halls registered by the use of hall buttons within a unit time are totaled for all the floors, and LDD: the number of hall down calls obtained in such a way that down calls on the halls registered by the use of the hall buttons within the unit time are totaled for all the floors.

In case of utilizing the number of cage calls as the traffic volume, it can be estimated by defining LDU and LDD to be the number of cage calls from lower floors to upper floors and the number of cage calls from upper floors to lower floors, respectively.

Further, in case of utilizing the waiting time as the traffic volume, it can be estimated by defining the following:

LDU: a value obtained in such a way that waiting times for hall up calls in a section [k, k+1] are totaled for all the floors, the resulting total value is divided by the number of up calls, and the resulting quotient is multiplied by the period of time of the section [k, k+1], and LDD: a value obtained in such a way that waiting times for hall down calls in the section [k, k+1] are totaled for all the floors, the resulting total value is divided by the number of down calls, and the quotient is multiplied by the period of time of the section [k, k+1].

Still further, in case of utilizing the maximum waiting time as the traffic volume, it can be estimated by defining the following:

LDU: a value obtained in such a way that the maximum waiting time for hall up calls through all the floors in a section [k, k+1] is multiplied by the period of time of the section [k, k+1], and LDD: a value obtained in such a way that the maximum waiting time for hall down calls through all the floors in the section [k, k+1] is multiplied by the period of time of the section [k, k+1].

Yet further, in case of utilizing the riding period of time as the traffic volume, it can be estimated by defining the following:

LDU: a value obtained in such a way that the average riding period of time during which passengers to ascend from lower floors ride in elevator cages in a section [k, k+1], namely, (the total of the riding periods of time of respective passengers)/(the number of passengers) is multiplied by the period of time of the section [k, k+1], and LDD: a value obtained in such a way that the average riding period of time during which passengers to descend from upper floors ride in the elevator cages in the section [k, k+1], namely, (the total of the riding periods of time of respective passengers)/(the number of passengers) is multiplied by the period of time of the section [k, k+1].

Yet further, in case of utilizing the number of times of passage due to the full capacity of passengers, as the traffic volume, it can be estimated by defining the following:

LDU: the number of times by which elevator cages ascending from lower floors have passed up direction calls on account of the full capacity in a section [k, k+1], and LDD: the number of times by which the elevator cages descending from upper floors have passed down direction calls on account of the full capacity in the section [k, k+1].

As thus far described, this invention consists in an apparatus for estimating the traffic condition value of elevators wherein the period of time of elevator operation is divided into a plurality of sections, the traffic condition value concerning the elevators is measured for each of the sections, and the traffic demand value of the corresponding section is estimated from the measured value; comprising comparison means to compare the measured value and the estimated value already obtained, and weighting means to weight the measured value on the basis of a result of the comparison, the traffic demand value being estimated anew from the weighted measured value. This brings forth the effect that the estimated value can be prevented from greatly differing from an actual traffic demand, and the elevators can be group-supervised as intended.

What is claimed is:

1. A demand estimation apparatus for controlling machines wherein a cycle of a cyclically fluctuating demand is divided into a plurality of sections having predetermined time widths, said apparatus comprising:

means for providing a measured demand value for each section of a cycle;

means for determining an estimated demand value for the demand in each section of a cycle on the basis of the measured demand value for a corresponding section of a previous cycle and a weight coefficient;

comparison means for comparing the measured demand value and the estimated demand value for each section of a cycle; and weighting means for producing said weight coefficient for each section of a cycle on the basis of the result of the comparison for each section.

2. An apparatus according to claim 1 wherein when the result of the comparison between the measured value and the estimated value in each section is large, the weight coefficient produced by said weighting means is smaller than when the result of the comparison is small.

3. An apparatus according to claim 2 wherein the measured value for each section includes at least one of an up-direction measured demand value and a down-direction measured demand value and the estimated value includes at least one of an estimated up-direction demand value and an estimated down-direction demand value.

4. An apparatus according to claim 3 where the result of the comparison for each section between the measured value and the estimated value is obtained on the basis of comparison between the up-direction measured demand value and the estimated up-direction demand value and between the down-direction measured demand value and the estimated down-direction demand value.

5. An apparatus according to claim 4 wherein the result of the comparison for each section between the measured value and the estimated value is compared with a predetermined reference value, and when the result is smaller than said reference value, the weight produced by said weighting means is not changed whereas when the result is larger than said reference value, the weight produced by said weighting means is changed.

6. An apparatus according to claim 2 wherein when said weight coefficient is 0 (zero), the estimated demand value does not change.

7. An apparatus according to claim 2 wherein said weighting means provides a plurality of weight coefficients depending upon the extent of the difference between the measured and estimated values.

* * * * *